US012696941B1

(12) United States Patent
Anderson et al.

(10) Patent No.: US 12,696,941 B1
(45) Date of Patent: Aug. 4, 2026

(54) LONG TORSO GARMENT ADAPTED FOR WEAR BY WHEELCHAIR OCCUPANT

(71) Applicant: TARGET BRANDS, INC., Minneapolis, MN (US)

(72) Inventors: Marilyn Anderson, Denver, MN (US); Erin Nicole Dineen, Minneapolis, MN (US); Alycia R. Anderson, Roseville, CA (US)

(73) Assignee: TARGET BRANDS, INC., Minneapolis, MN (US)

( * ) Notice: Subject to any disclaimer, the term of this patent is extended or adjusted under 35 U.S.C. 154(b) by 0 days.

(21) Appl. No.: 19/359,679

(22) Filed: Oct. 15, 2025

(51) Int. Cl.
*A41D 13/12* (2006.01)
*A41D 3/02* (2006.01)

(52) U.S. Cl.
CPC ..... *A41D 3/02* (2013.01); *A41D 2600/00* (2013.01)

(58) Field of Classification Search
CPC ..... A41D 3/02; A41D 2600/00
See application file for complete search history.

(56) References Cited

U.S. PATENT DOCUMENTS

| | | | | |
|---|---|---|---|---|
| 1,168,698 | A | 1/1916 | Andrews | |
| 1,403,030 | A | 1/1922 | Janzow | |
| 1,626,024 | A | 4/1927 | Crane | |
| 1,805,766 | A | 5/1931 | Groves | |
| D130,692 | S | 12/1941 | Lardner | |
| 2,374,643 | A | 5/1945 | Boettcher | |
| 2,437,223 | A * | 3/1948 | Dutrow | A41D 13/01 D2/839 |
| 2,497,764 | A | 2/1950 | Doughty | |
| 2,686,914 | A | 8/1954 | Weiser | |

(Continued)

FOREIGN PATENT DOCUMENTS

| | | |
|---|---|---|
| FR | 2879406 A1 | 6/2006 |
| WO | 9923901 A2 | 5/1999 |

(Continued)

OTHER PUBLICATIONS

"Adapting Creatively: Split-back Wheelchair Jacket", printed from http://adaptingcreatively.blogspot.com/2010/11/split-back-wheelchair-jacket.html, publicly available at least as early as Dec. 30, 2010 (12 pages).

(Continued)

*Primary Examiner* — Robert H Muromoto, Jr.
(74) *Attorney, Agent, or Firm* — Griffiths & Seaton PLLC; JoAnn M. Seaton

(57) ABSTRACT

A garment is described for covering a torso and a portion of a lower body of a user when the user wears the garment body. The garment includes a front panel and a rear panel coupled to the front panel forming a cavity therebetween to receive the torso and the portion of the lower body. The rear panel defines an exterior surface facing away from the front panel and an interior surface facing toward the front panel. The interior surface is divided into a top section and a bottom section, the top section is configured to at substantially align with the torso, and the bottom section is configured to substantially align with the portion of lower body. The top section is defined by a first lining material, and the bottom section is defined by a second lining material having a greater coefficient of friction than the first lining material.

20 Claims, 12 Drawing Sheets

(56) References Cited

U.S. PATENT DOCUMENTS 3,369,256 A 2/1968 Kern
3,389,407 A 6/1968 Morrison
3,594,817 A * 7/1971 Kelly ..... A41D 13/0575 2/23
3,997,921 A 12/1976 Knight
4,217,663 A 8/1980 Goldberg et al.
4,429,419 A 2/1984 Snyder
4,476,587 A 10/1984 Itoi
4,573,218 A 3/1986 Saggs
4,575,876 A 3/1986 Weaver
4,644,590 A 2/1987 Pincham
4,674,132 A 6/1987 Stein et al.
4,707,862 A 11/1987 Gerber
4,843,654 A * 7/1989 March ..... A41D 1/086 2/232
4,864,657 A 9/1989 Lake
4,912,860 A 4/1990 Keller
4,920,578 A 5/1990 Janzen et al.
4,995,115 A 2/1991 Ellis
5,015,037 A * 5/1991 Giblin ..... A47D 15/006 297/DIG. 2
5,084,914 A 2/1992 Hesch
5,101,514 A * 4/1992 Eklund ..... A41D 13/0537 2/87
5,111,544 A * 5/1992 Graebe ..... A47C 7/021 5/490
5,123,113 A * 6/1992 Smith ..... A61F 13/10 128/892
5,306,231 A * 4/1994 Cullum ..... A61H 1/0218 602/35
5,346,278 A * 9/1994 Dehondt ..... A47D 15/006 297/219.12
5,369,804 A 12/1994 Metcalf
D356,204 S 3/1995 Derrickson
5,410,758 A 5/1995 Dupont et al.
5,542,123 A 8/1996 DiPietro
5,564,123 A 10/1996 Grassick
5,572,742 A 11/1996 McFadden
D385,090 S 10/1997 Dipietro
5,740,567 A * 4/1998 Mitchell ..... A47G 27/0225 4/582
5,799,330 A 9/1998 O'Donoghue-Kitt
5,815,833 A 10/1998 Kuo
5,829,057 A * 11/1998 Gunn ..... A41D 31/12 2/243.1
5,911,312 A 6/1999 Holyfield
5,948,707 A * 9/1999 Crawley ..... A41D 31/102 442/76
D431,344 S 10/2000 Briceno
D435,329 S 12/2000 Stewart
6,216,270 B1 4/2001 Moquin et al.
6,301,717 B1 * 10/2001 Matsumoto ..... A41D 13/0015 2/243.1
D451,661 S 12/2001 Costello
6,343,383 B1 * 2/2002 Madorma-Williams ..... A41B 13/04 2/300
6,378,139 B1 * 4/2002 Mazzaglia ..... A41B 11/12 2/242
6,766,536 B1 * 7/2004 Aarons ..... A41D 19/01558 2/161.3
6,961,969 B2 * 11/2005 Nichols ..... A63B 21/4037 5/420
7,137,157 B2 * 11/2006 Nichols ..... A47G 9/062 5/420
7,191,470 B2 * 3/2007 Benini ..... A41D 13/0002 2/69
D563,628 S 3/2008 Corbin et al.
D566,927 S 4/2008 Graham
7,356,852 B2 * 4/2008 Thai ..... A41D 19/0062 2/161.7
7,383,591 B1 * 6/2008 Getzwiller ..... A63B 71/14 36/114
D581,633 S 12/2008 Seibold
7,540,037 B1 * 6/2009 Bittler ..... A41D 27/28 2/69
7,748,056 B2 * 7/2010 Mickle ..... A41D 13/0512 2/267
7,779,485 B2 8/2010 Gandy
D624,280 S 9/2010 Halseth
D635,334 S 4/2011 Eckman et al.
D635,335 S 4/2011 Eckman et al.
D635,739 S 4/2011 Toms et al.
7,966,669 B1 6/2011 Siepmann
8,430,204 B1 4/2013 Reynolds
8,522,364 B2 9/2013 O'Brien
8,566,964 B1 10/2013 Acosta
8,650,664 B2 2/2014 Parr
8,656,516 B1 2/2014 Reinhardt Rawlings et al.
D714,026 S 9/2014 Adams et al.
D714,027 S 9/2014 Adams et al.
8,832,867 B2 9/2014 Boyle
8,850,620 B1 10/2014 Carretero
8,919,347 B2 * 12/2014 Carlson ..... A61G 7/057 66/196
8,950,013 B2 * 2/2015 Bates ..... A41D 13/0002 2/115
9,060,553 B2 6/2015 Crye
D733,393 S 7/2015 Callahan
D734,924 S 7/2015 Emery
9,089,174 B1 7/2015 Michaelis
D742,622 S 11/2015 Oygarden et al.
9,241,853 B2 * 1/2016 Carlson ..... A61G 7/057
D749,821 S 2/2016 Mcclora
9,364,035 B1 6/2016 Shachaf
D760,474 S 7/2016 Alonzo
9,380,816 B2 7/2016 Jo Longfellow
9,392,860 B2 7/2016 Redli
9,420,872 B2 8/2016 Bird
9,554,601 B2 1/2017 Arajakis
9,723,882 B2 8/2017 Reuben
9,907,344 B2 3/2018 Poore et al.
9,924,749 B2 3/2018 Walker
9,980,526 B2 5/2018 Silverberg
10,010,160 B1 7/2018 Ostrowski et al.
D831,934 S 10/2018 Lee
D834,787 S 12/2018 Picot
10,154,698 B2 12/2018 Loveland
D839,550 S 2/2019 Wu et al.
D856,634 S 8/2019 Mills
D868,424 S 12/2019 Gelati
10,499,694 B2 12/2019 Henry et al.
D888,369 S 6/2020 Schickel
10,690,439 B1 6/2020 Gillett
D897,636 S 10/2020 Bogdan et al.
D898,329 S 10/2020 Bogdan et al.
10,842,209 B2 11/2020 Kennedy et al.
D903,239 S 12/2020 Crosse
D920,633 S 6/2021 Mahoney
11,051,568 B2 7/2021 Reimer
11,064,747 B2 7/2021 Zahradka et al.
11,140,931 B1 10/2021 Stewart
11,259,581 B2 3/2022 Saladino
D947,500 S 4/2022 Bogdan et al.
11,317,662 B2 5/2022 Watts
11,612,190 B2 * 3/2023 Webb ..... A41B 1/08 2/115
11,660,495 B2 * 5/2023 Paton ..... A63B 71/0054 5/417
11,986,029 B2 5/2024 Hirschmann, Jr.
2004/0010837 A1 1/2004 Graves
2004/0019950 A1 * 2/2004 Rast ..... A41D 13/0587 2/77
2004/0133963 A1 7/2004 Jennings
2004/0172763 A1 * 9/2004 Sachs ..... A47C 3/16 5/652
2004/0194190 A1 10/2004 Gathings, Jr.
2005/0022285 A1 2/2005 Berns et al.
2005/0114978 A1 * 6/2005 Benini ..... A41D 13/0151 2/244

(56) References Cited

U.S. PATENT DOCUMENTS

| | | | | |
|---|---|---|---|---|
| 2005/0150030 | A1* | 7/2005 | Davis | A41D 13/0537 2/69 |
| 2005/0193469 | A1 | 9/2005 | Kronenberger | |
| 2006/0041991 | A1* | 3/2006 | Kim Sim | A41D 19/0062 2/168 |
| 2006/0272071 | A1* | 12/2006 | Mickle | A41D 13/0512 2/69 |
| 2007/0220673 | A1* | 9/2007 | Nichols | A41D 31/125 5/944 |
| 2008/0121305 | A1* | 5/2008 | Metzger | A41B 11/005 36/43 |
| 2010/0031413 | A1 | 2/2010 | Jensen | |
| 2010/0050316 | A1* | 3/2010 | Leonard | D03D 15/41 604/289 |
| 2010/0199404 | A1 | 8/2010 | Garza | |
| 2010/0229278 | A1* | 9/2010 | Bates | A41D 13/0002 2/243.1 |
| 2010/0313323 | A1 | 12/2010 | Tennelle | |
| 2011/0030118 | A1 | 2/2011 | Pratchett | |
| 2011/0145973 | A1 | 6/2011 | Cohen | |
| 2011/0173737 | A1 | 7/2011 | Lawver | |
| 2011/0239350 | A1 | 10/2011 | Ho et al. | |
| 2013/0065484 | A1 | 3/2013 | Ducoulombier | |
| 2013/0175838 | A1* | 7/2013 | Oshima | B60N 2/7094 297/284.3 |
| 2013/0270881 | A1* | 10/2013 | Fowler | A61G 5/10 297/219.1 |
| 2014/0223630 | A1* | 8/2014 | Johnson | A41D 13/0015 2/69 |
| 2015/0196063 | A1 | 7/2015 | Dougherty | |
| 2015/0208737 | A1* | 7/2015 | Nevins | A41D 1/22 2/74 |
| 2015/0351469 | A1* | 12/2015 | McGovern | A41D 13/1254 442/184 |
| 2016/0219953 | A1 | 8/2016 | Wang | |
| 2016/0324220 | A1 | 11/2016 | Shotey | |
| 2017/0027254 | A1 | 2/2017 | Myerscough | |
| 2017/0196277 | A1 | 7/2017 | Henry et al. | |
| 2018/0199647 | A1 | 7/2018 | Kennedy et al. | |
| 2019/0045849 | A1 | 2/2019 | Takasaki | |
| 2019/0082750 | A1 | 3/2019 | Matuszak et al. | |
| 2019/0090620 | A1 | 3/2019 | Thomas | |
| 2019/0110538 | A1 | 4/2019 | Ghasletwala | |
| 2019/0223526 | A1 | 7/2019 | Knodt | |
| 2020/0068960 | A1* | 3/2020 | Oliver | A41D 13/129 |
| 2020/0214430 | A1 | 7/2020 | Juliar et al. | |
| 2021/0045464 | A1 | 2/2021 | Green | |
| 2021/0204622 | A1 | 7/2021 | Ichigaya et al. | |
| 2021/0298392 | A1* | 9/2021 | Pearson | A41D 3/02 |
| 2021/0360994 | A1* | 11/2021 | Takada | A41D 13/0525 |
| 2021/0378330 | A1 | 12/2021 | Min | |
| 2022/0022663 | A1* | 1/2022 | Lazzaro | A47D 15/008 |
| 2022/0039498 | A1 | 2/2022 | Schickel | |
| 2022/0160063 | A1 | 5/2022 | Li et al. | |
| 2022/0183409 | A1 | 6/2022 | Williamson, II | |
| 2023/0025919 | A1 | 1/2023 | Reuben | |
| 2023/0240393 | A1 | 8/2023 | Lebrun et al. | |

FOREIGN PATENT DOCUMENTS

| | | | | |
|---|---|---|---|---|
| WO | WO-03015549 | A1 * | 2/2003 | A41D 1/00 |
| WO | 2006086548 | A2 | 8/2006 | |
| WO | 2018156204 | A1 | 8/2018 | |
| WO | 2018222451 | A1 | 12/2018 | |

OTHER PUBLICATIONS

"Adaptive Cardigans from Debra Lynn", printed from www.debralynncreations.ca/adaptive-cardigans.html, publicly available at least as early as Sep. 13, 2014 (4 pages).

"Adaptive Clothing for Men—Open Back Snap Shirt", printed from www.pinterest.com/pin/321937073336055000/, publicly available at least as early as Jun. 29, 2017 (5 pages).

"Adaptive Ladies Cardigan", printed from www.gerifashions.com/adaptive-ladies-cardigan-lat003/, publicly available at least as early as May 14, 2017, per http://web.archive.org (2 pages).

"Adaptive Winter Wheelchair Coat", printed from www.etsy.com/il-en/listing/477279301/adaptive-winter-wheelchair-coat, publicly available at least as early as Sep. 7, 2016 (3 pages).

"Ayr Jacket (Lengthened Front)", printed from www.capr-style.com/product/ayr-jacket-lengthened-front-2/, publicly available at least as early as May 9, 2016, per http://web.acrhive.org (3 pages).

"Chemo Cozy Boys' Fleece Jacket", printed from www.chemocozy.com/collections/chemo-cozy-kids/products/boys-fleece-jacket-yellow, publicly available at least as early as Oct. 10, 2014, per http://web.archive.org (2 pages).

"Dignity Pajamas Mens Cotton Short Sleeve Adaptive Open Back Hospice Patient Gown Sleepwear", printed from www.dignitypajamas.com/Mens-Short-sleeve-hospice-sleepwear-pajama-p/ss-102.htm, publicly available at least as early as Jun. 21, 2017 (2 pages).

"Grey Zip Back Jumpsuit Style Bodysuit Wonsie", printed from https://wonsie.com.au/collections/back-zip-wonsie/products/zip-back-bodysuit-wonsie, publicly available at least as early as Feb. 17, 2017, per http://web.archive.org (9 pages).

"Kinlock Jacket (Backopening and Rain Resistant)", printed from www.capr-style.com/product/kinlock-jacket-backopening-and-rain-resistant-3/, publicly available at least as early as Jan. 14, 2016, per http://web.archive.org (3 pages).

"Land's End Women's Outrigger Fleece," https://poshmark.com/listing/Lands-End-Womens-Outrigger-Fleece-Lined-Jacket-61dadcb5ffba94109dbcfea3, printed on Jun. 3, 2022 (2 pages).

"Mens' Custom Logo Outrigger Mesh Lined Jacket," https://business.landsend.com/Business-Uniforms/Outerwear/Jacke...xCLESe1yRQnZdkMdLEpnj0ROKSQ-YgUhuppqlaHdhKNzzv13saAiAHEALw_wcB, available at least as early as Jun. 3, 2020 (7 pages).

"Our Guide to Jacket Linings—Fabric Types, Half Vs Full Linings, Design Options," May 19, 2021, printed from https://www.rampleyandco.com/blogs/the-journal/complete-guide-suit-jacket-linings on Sep. 18, 2024 (_ pages).

"R215 Adults Back Fastening Hunter Jackets", printed from www.disabled-clothing.co.uk/disabled-adults-clothing/r215-adults-back-fastening-hunter-jackets.html#.WSh5WTOZM48, publicly available at least as early as Jan. 17, 2017, per http://web.archive.org (2 pages).

"Wheelchair Users Now Have a Clothing Line That Fits Their Needs", printed from www.fastcompany.com/3057044/wheelchair-users-now-have-a...&utm_medium=social&utm_source=facebook.com&utm_campaign=buffer, printed on Feb. 25, 2016 (3 pages).

Adaptive Clothing: Home Care Dressing Made Easier by Jane Zhdanova, posted to Ezra Home Care. Available date: Apr. 24, 2014 [site visited May 29, 2020] (_ pages).

Back Snap T-Shirt Short Sleeve posted to Adaptive Clothing Showroom. Available date: Jun. 30, 2016 [site visited May 29, 2020] (_ pages).

SOLOCOTE Girls Puffer Winter Coat Faux Down Fort Hood Sherpa Lined Heavyweight Water-Resistant Parka Jacket, printed from https://www.amazon.com/SOLOCOTE-Puffer-Heavyweight-Water-Resi...5021pAnSA%3D%3D&sr=1-49-48f7baba-8e26-45f3-8811-e1a601ad20bf publicly availble at least as earlier as Mar. 28, 2023 (_pages).

* cited by examiner

LONG TORSO GARMENT ADAPTED FOR WEAR BY WHEELCHAIR OCCUPANT

BACKGROUND OF INVENTION

Wheelchair occupants not only face the difficulties their disabilities, injuries, or other afflictions place upon them, but also face the additional difficulties associated with finding clothing that accommodates their wheelchair and/or other treatment devices supported by their wheelchair and/or any diminished motor skills the wheelchair occupant may have. These difficulties are exasperated in instances when a long clothing item for the torso is desired that extends below the waist of the wheelchair occupant. Having a clothing item positioned between the wheelchair seat and the bottom of the occupant may present a slipping hazard that may can cause the occupant to easily slide down in the seat of the wheelchair. Not only is an undesired, downward slide uncomfortable for the occupant, but when considered in combination with occupant straps and/or perhaps other medical devices coupled to the occupant such as feeding tubes, air tubes, medication supply lines, etc. can cause danger to the occupant or at least cause disconnection or improper connection with these important medical devices. At the same time as causing slipping or in other instances, excess material between the occupant and the wheelchair seat can bunch and cause pinch, pain, or pressure points against the legs of the occupant.

In addition, having a longer garment wrapped around the wheelchair occupant can make it difficult for the occupant or a care giver to adjust the positioning of the clothing item relative to the occupant and/or the position of the occupant within the wheelchair and/or to move the occupant into and out of the wheelchair especially when the occupant has diminished motor skills. The excess material of a longer garment oftentimes makes it difficult to grasp a wheelchair occupant securely to move the occupant within the wheelchair and/or to move the wheelchair occupant in and out of the wheelchair.

SUMMARY OF THE INVENTION

A garment is described for covering a torso and a portion of a lower body of a user when the user wears the garment body. The garment includes a front panel and a rear panel coupled to the front panel forming a cavity therebetween to receive the torso and the portion of the lower body when the user wears the garment body. The rear panel defines an exterior surface facing away from the front panel and an interior surface facing toward the front panel. The interior surface is divided into a top section and a bottom section, the top section is configured to at substantially align with the torso when the user wears the garment body, and the bottom section is configured to substantially align with the portion of lower body of the user when the user wears the garment body. The top section of the interior surface is defined by a first lining material, and the bottom section of the interior surface is defined by a second lining material having a greater coefficient of friction than the first lining material. Other garments, assemblies, and associated methods are also described herein.

BRIEF DESCRIPTION OF DRAWINGS

Embodiments of the invention will be described with respect to the figures, in which like reference numerals denote like elements, and in which.

DESCRIPTION OF THE INVENTION

Figure 1:
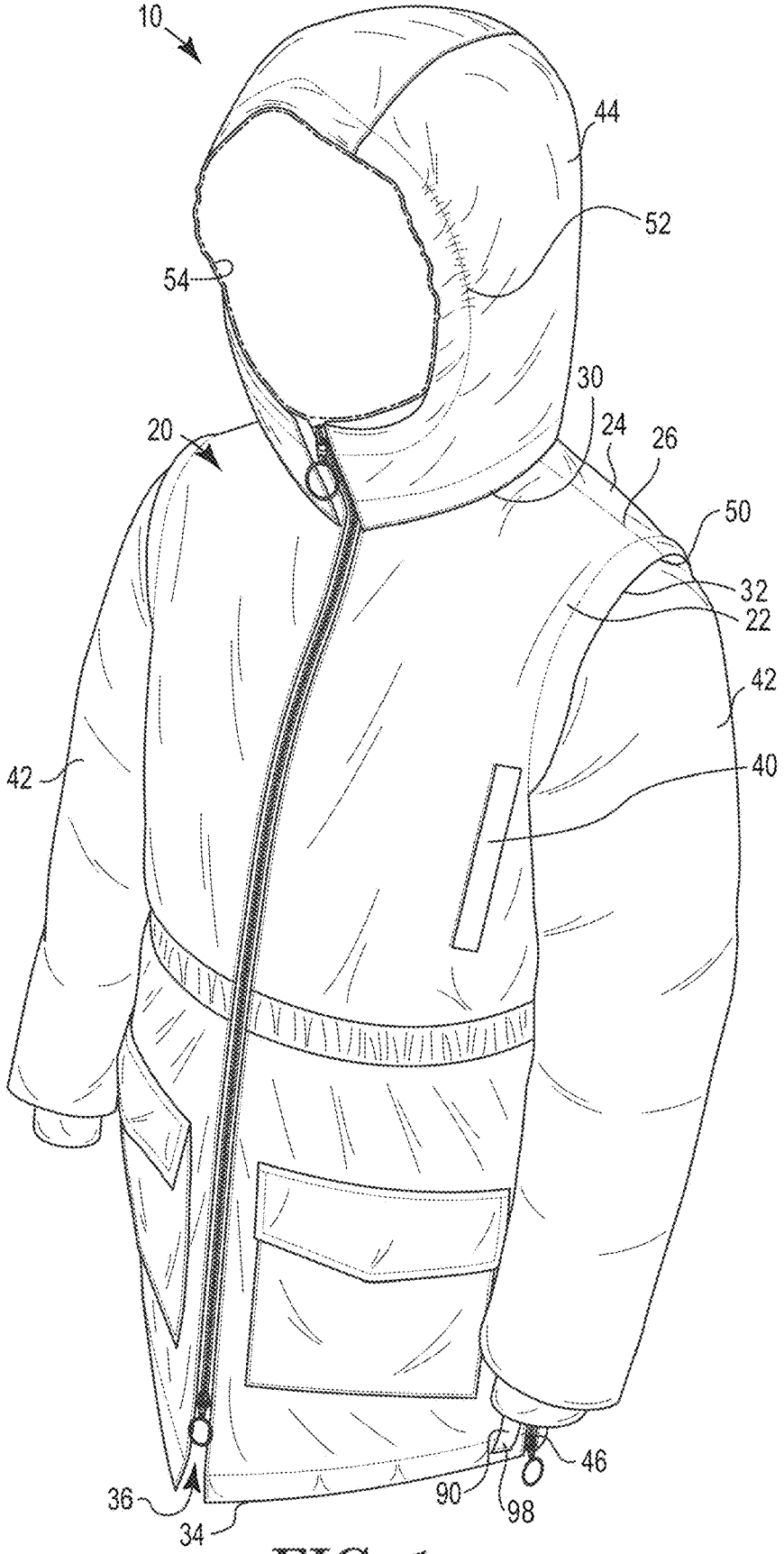
FIG. 1 is a front, perspective view illustration of a garment, according to an embodiment of the invention.
Figure 2:
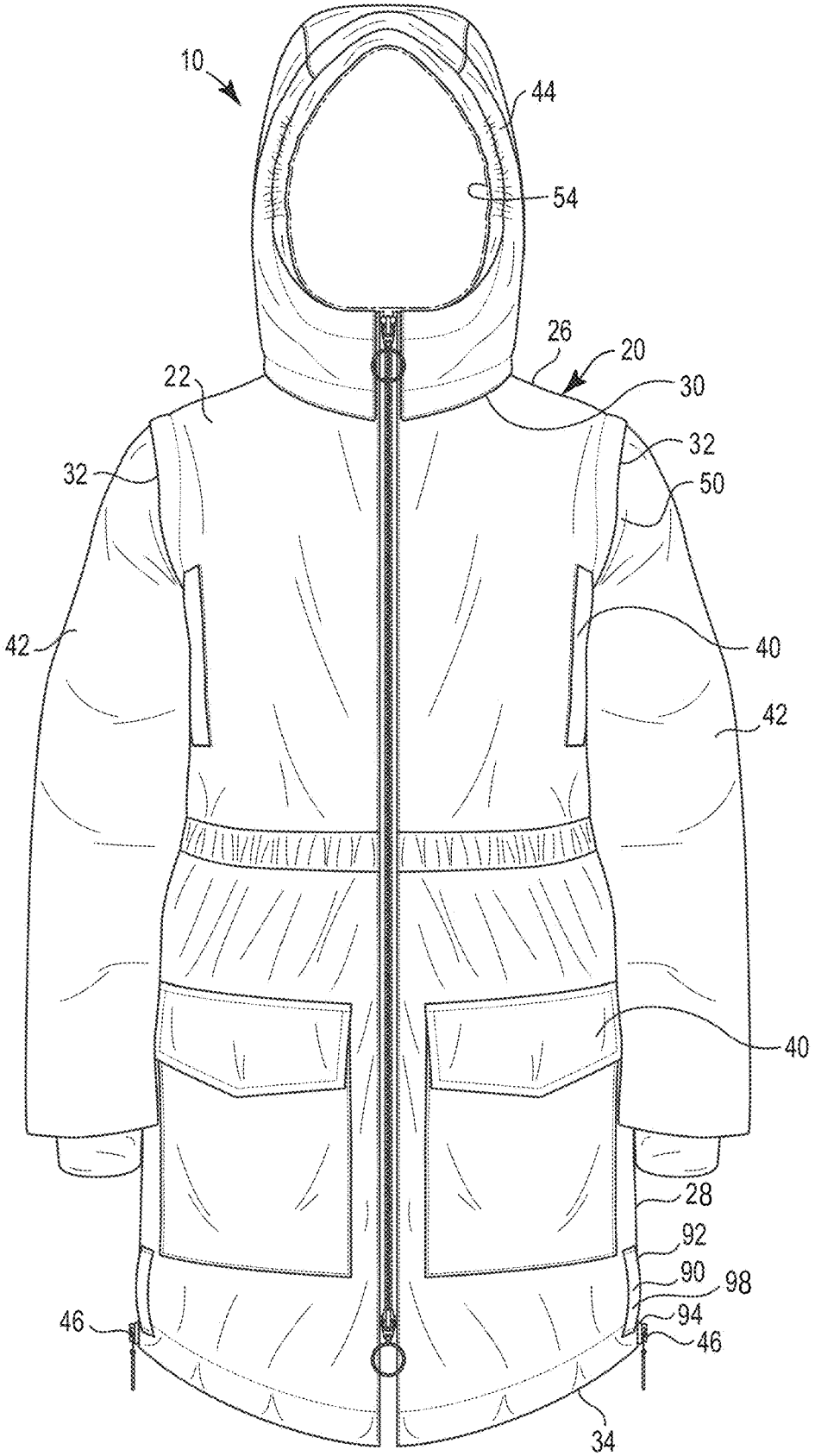
FIG. 2 is a front view illustration of the garment of FIG. 1, according to one embodiment of the present invention.
Figure 3:
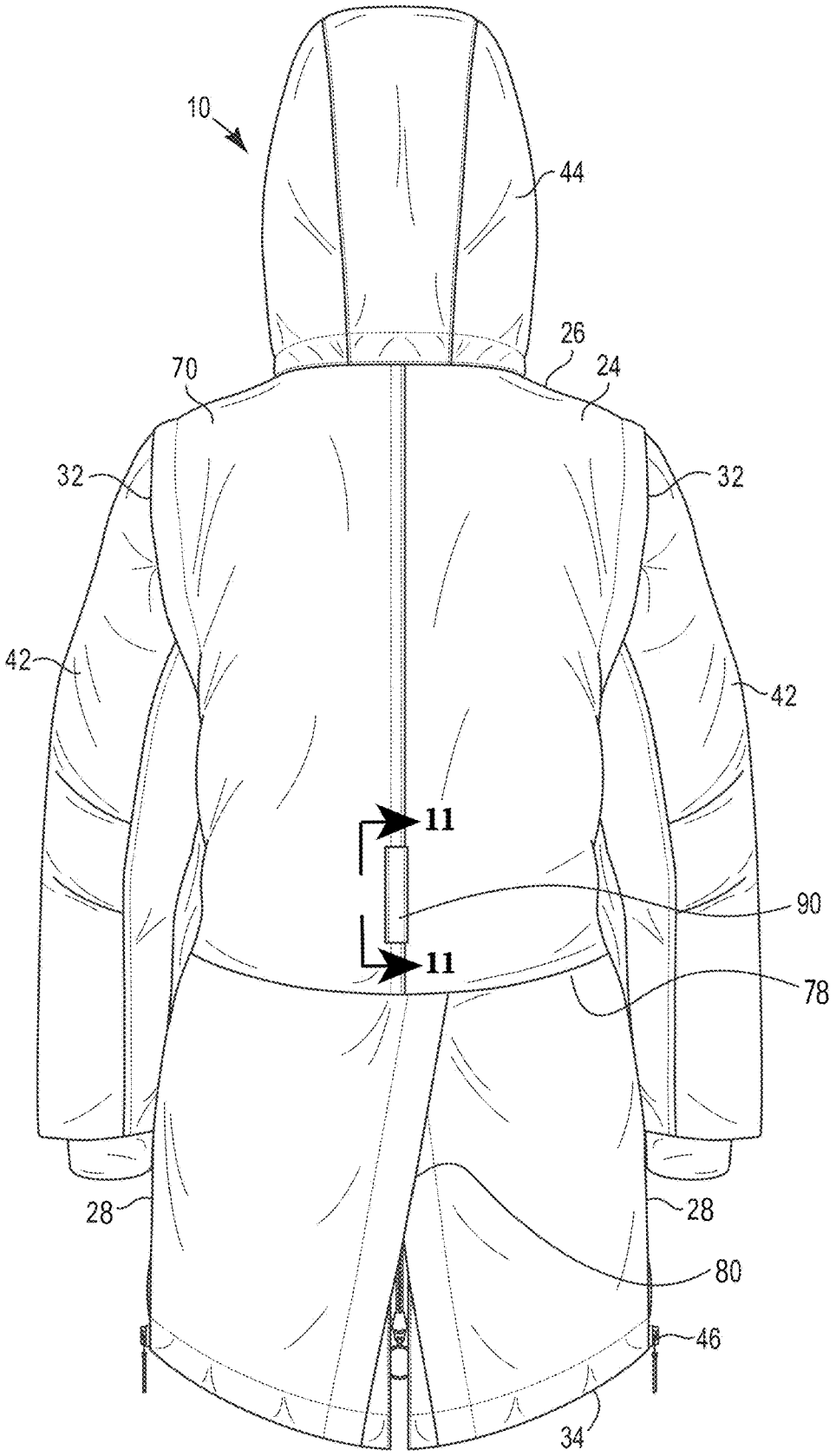
FIG. 3 is a rear view illustration of the garment of FIG. 1, according to one embodiment of the present invention.
Figure 4:
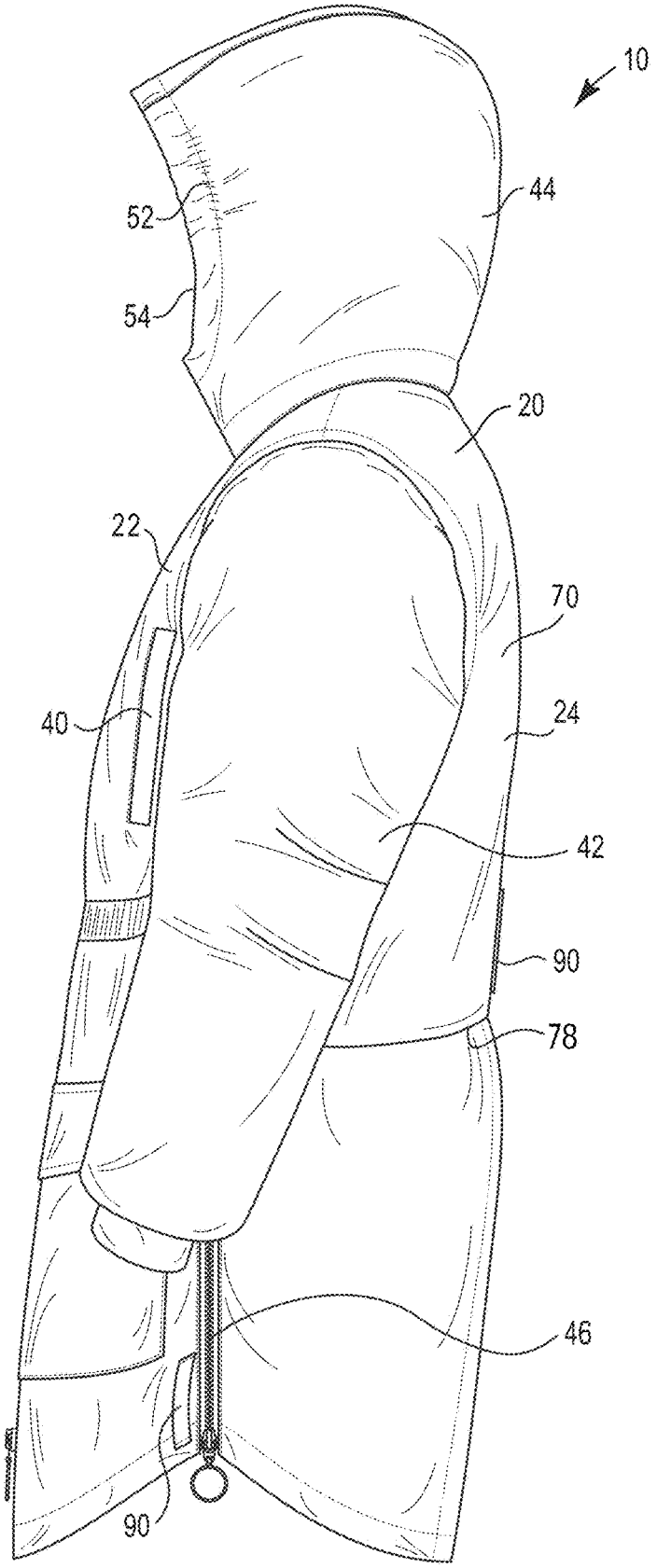
FIG. 4 is a right-side view illustration of the garment of FIG. 1, according to one embodiment of the present invention, where the left-side view is a mirror image of the right-side view.
Figure 5:
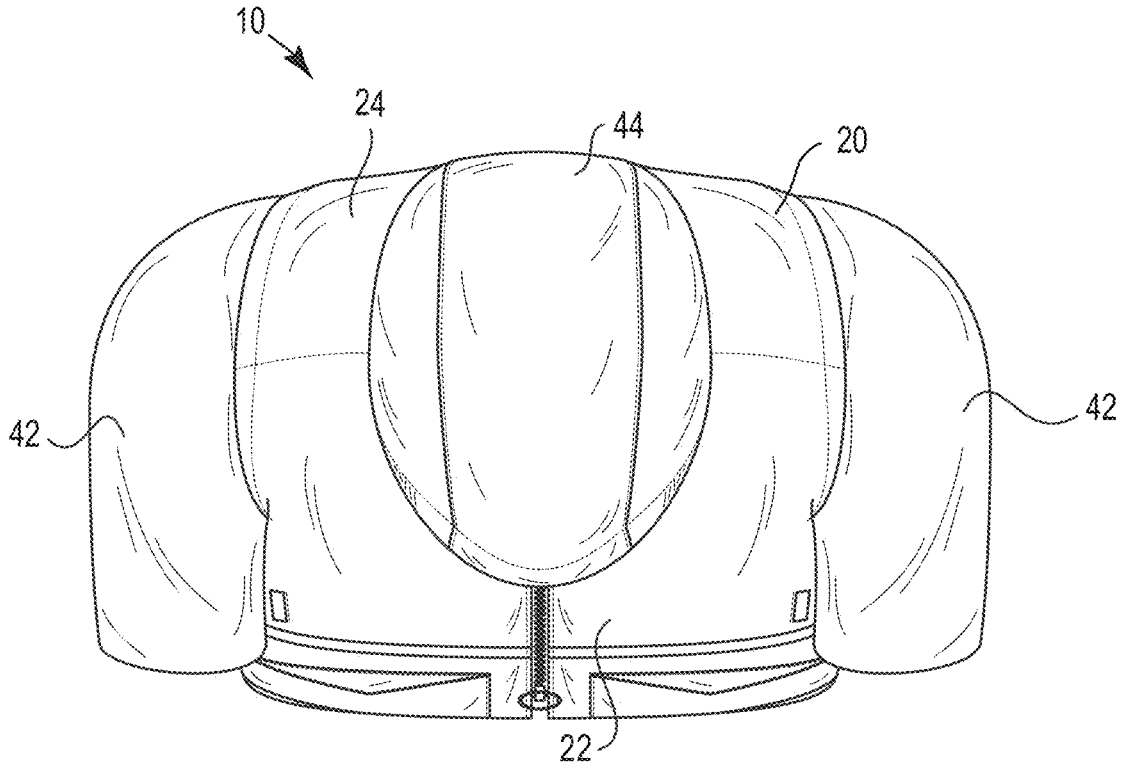
FIG. 5 is a top view illustration of the garment of FIG. 1, according to one embodiment of the present invention.
Figure 6:
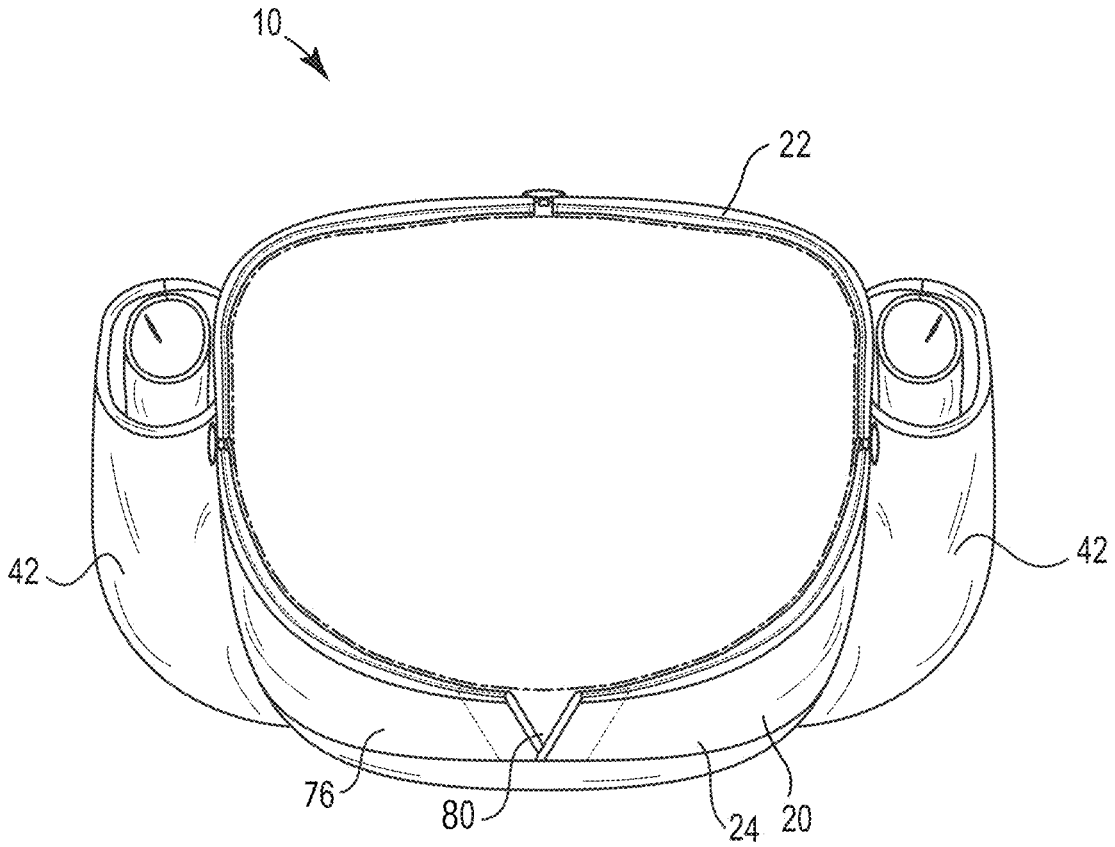
FIG. 6 is a bottom view illustration of the garment of FIG. 1 with the inside of the torso portion of the garment omitted, according to one embodiment of the present invention.

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. Directional terminology, such as "front," "back," etc. is used with reference to the orientation in the figure(s) being described. Any directional terminology is used for purposes of illustration and is in no way limiting. In addition, as used herein, the terms "about" or "substantially" apply to all numeric values or descriptive terms, respectively, and generally indicate a range of numbers or characteristics that one of skill in the art would consider equivalent to the recited values or terms, that is, having the same function or results.

Embodiments of the invention are directed a garment to be worn on a torso, such as a garment configured to be worn on the torso of a person that is at least periodically an occupant of a wheelchair. In one example, while the garment is configured to be primarily worn on the torso, the garment has a length sufficient to extend down below a buttock of the occupant, for example, down to at least a mid-thigh region of the occupant, and, in one instance, to cover a majority or even an entirety of the occupant's thigh. The garment is specifically configured to add friction to decrease slippage between the occupant, garment, and wheelchair seat under the buttock and thigh regions of the occupant.

In one example, the garment includes other or additional features to facilitate the occupant. For instance, the garment may include loops one the exterior of the garment of reinforced nature configured to aid a caregiver or the occupant in in maneuvering the occupant into, out of, and within the wheelchair. In one embodiment, one or more maneuvering loops may be included near the waistline of the garment, for example, on the back panel of the garment and/or on the front panel of the garment. In one example, a maneuvering loop is provided along the back centerline of the garment, such as a substantially vertically positioned loop, that is a loop extending substantially perpendicularly to the waistline of the garment. In one example, one of more maneuvering loops are provided near the intersection of the front panel and rear panel of the garment.

To further aid in the versatility of the garment for the occupant, the garment may include one or more of openable bottom side seams, removable sleeves, a removable hood, mitten cuff, hook-and-loop fastening pockets, and easily selectively closable front vertical opening. Lengths of elastica are also utilized to enhance the fit of the garment such that when the adaptive features of the garment are utilized to accommodate the occupant in using the wheelchair and/or any other medical devices secured to and/or supported by the wheelchair, the garment retains its integrity to fit and look as much like a garment of its typical type as it can to further bolster not only the functionality of the garment but also the spirit of the occupant. In one example, the garment may be of various types of garments worn on a torso and extend down to and covering a portion of a thigh of a user including, but not limited to, a jacket, a parka, a coat, a sweatshirt, a shirt, blouse, vest, tunic, dress, sweater, cardigan, kaftan, pajama, etc.

Figure 13:
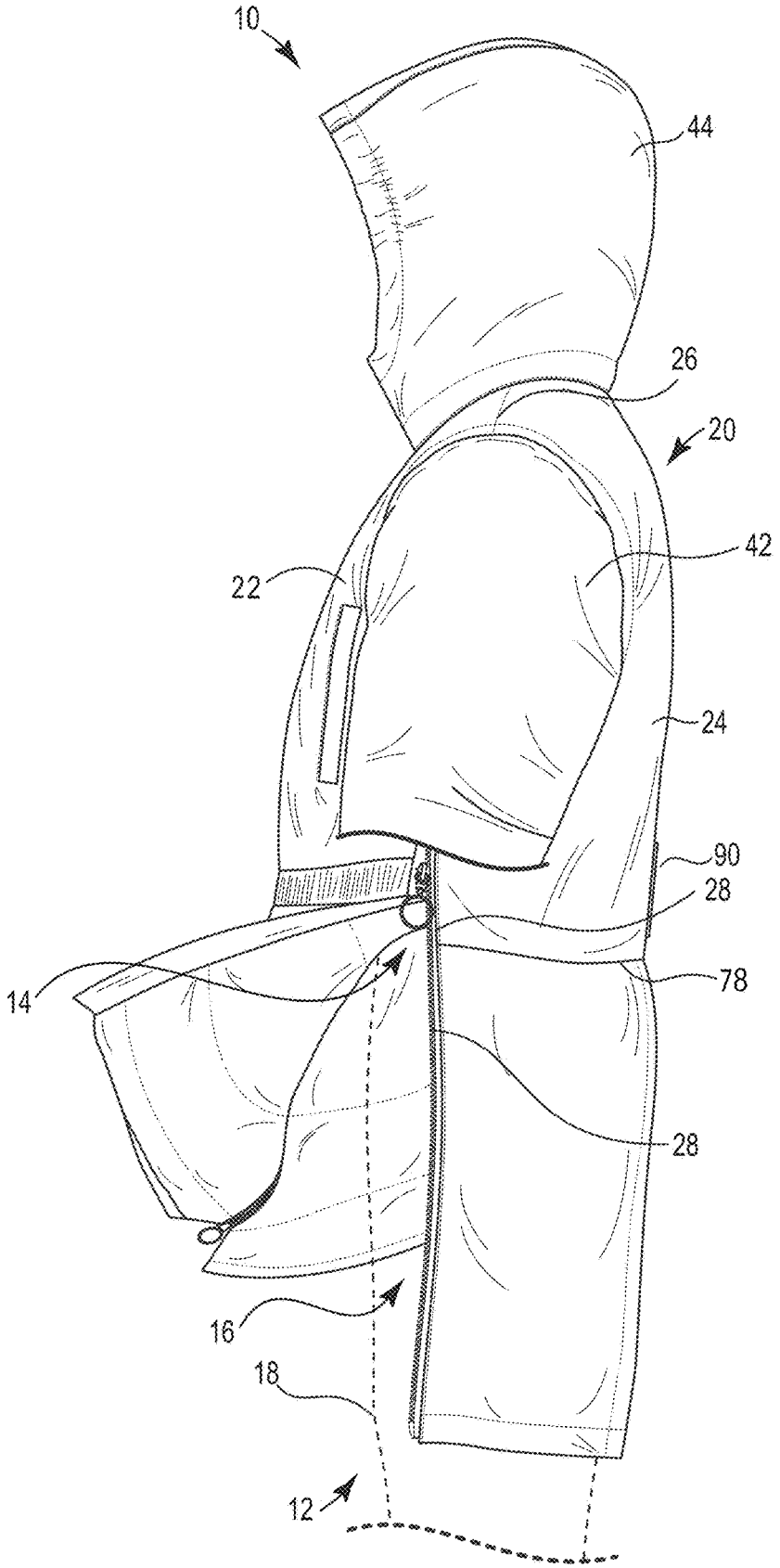
FIG. 13 is a right-side view illustration of the garment of FIG. 1 with a portion of the right sleeve removed for illustration purposes, a right-side zipper at least partially unzipped, and the front panel at least partially separated from the rear panel, according to one embodiment of the present invention.

Turning to the figures, FIGS. 1-6 illustrate various views of one example of a garment 10, according to the present invention, such as a garment configured to be worn by a user 12, as generally indicated in FIG. 13, that is at least a periodic occupant of a wheelchair. Garment 10 is generally configured to be worn on and substantially cover a torso 14, generally indicated in FIG. 13, of user 12 but, additionally, in one embodiment, extends down to cover a portion of the thighs 16, generally indicated in FIG. 13, of user 12 as well. In one example, garment 10 is knee-length meaning it extends down to at least the knees 18, generally indicated in FIG. 13, of user 12. The buttocks (not shown) thighs 16, knees 18 and/or whatever other portions of user 12 that are covered by garment 10 below the waist of user 12 are consider a portion of the lower body of user 12 covered by garment 10, or more specifically, garment body 20 as will be further discussed below.

In covering a portion of thighs 16 of user 12, when user sits in a wheelchair or other chair (not shown), user 10 sits on garment 10, that is sandwiches or transposes garment 10 between user 12 and the wheelchair, in a manner that will be apparent to those of skill in the art upon reading this application, for example between the buttocks (not shown) and thighs 16 of user 10 and the seat of the wheelchair. Garment 10 is configured to prevent user 10 from slipping in the wheelchair by using friction enhancing design of garment 10 on at least the portions of garment 10 between user 12 and the wheelchair as will be further described below.

In one example, garment 10 includes a garment body 20 that substantially or entirely covers torso 14 of user 12 when worn by user 12. Garment body 20 generally includes a front panel 22 and a rear panel 24 coupled together, for example, via sewing, snaps, hook-and-loop fastener(s), zipper(s), magnet(s), other known securement methods, or combinations thereof directly or via other portions of material, etc., at a top edge 26 and opposing side edges 28 (FIG. 13) thereof to form a neck opening 30, a bottom opening 32, and opposing arm openings 34. A substantially annular or ovular, or otherwise suitably shaped, bottom opening 34 is formed opposite neck opening 30. More particularly, in one embodiment, neck opening 30 is formed in the top center of garment body 20 splitting top edge 26 substantially in half such that each side of top edge 26 extends outwardly from each side of neck opening 30 toward, and perhaps to, a different one of arm openings 32. In this manner, a cavity 36 is formed between front panel 22 and rear panel 24 sized to receive torso 14 and/or a portion of the lower body of user 12 as is further described herein and shown in FIG. 13.

In one example, garment 10 may include other various portions thereof such as pockets 40, sleeves 42, hoods 44, side zippers 46 or other various features as will be apparent to those of skill in the art upon reading the present application In one embodiment, any one or more of the pockets 40, sleeves 42, hoods 44, side zippers 46 or other various features are formed keeping in mind that users 12 that may find themselves in need of using a wheelchair may have other extra needs, such as diminished dexterity or other motor skill issues, and with an eye toward helping serve or diminish those needs. For example, if pockets 40 have closures (not shown), they may be easy to open and close closures such as magnetic or hook-and-loop closures. Sleeves 42 may be formed with a wider form to be easier to get in and out of and/or may be entirely removable from garment body 20 via a selective coupling 50, such as a zipper or other suitable coupling as shown, for example, in FIG. 7. Hood 44 similarly may have an easy closure, make use elastic 52 around its opening 54 to eliminate the need for a closure, and/or also be entirely removable via a selective attachment 56 such as a snap, hook-and-loop, magnetic, zipper, or other suitable closure as is also shown in FIG. 7.

Figure 7:
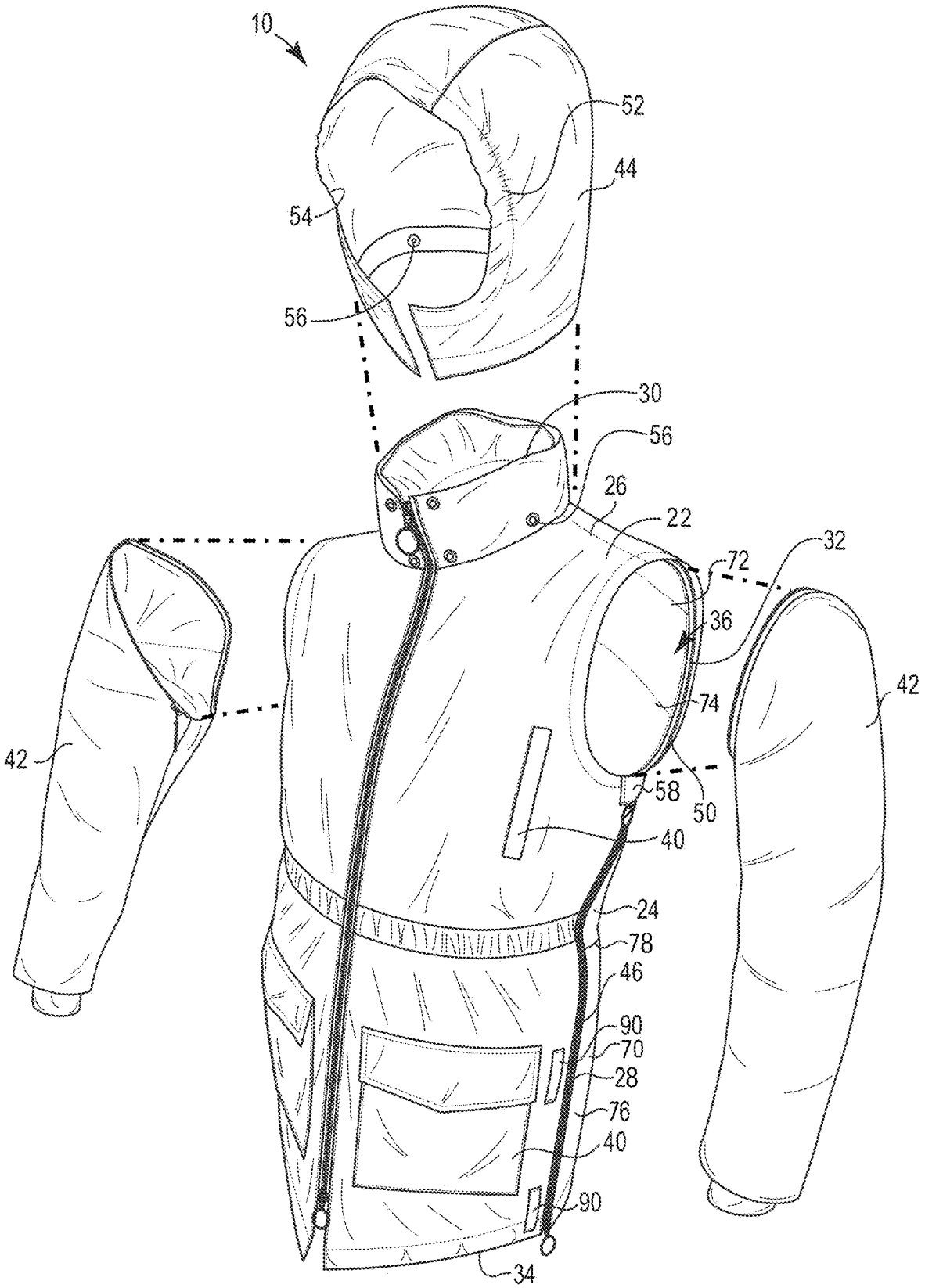
FIG. 7 is a front, perspective view illustration of the garment of FIG. 1 with the separable components exploded away from one another, according to one embodiment of the present invention.
Figure 8:
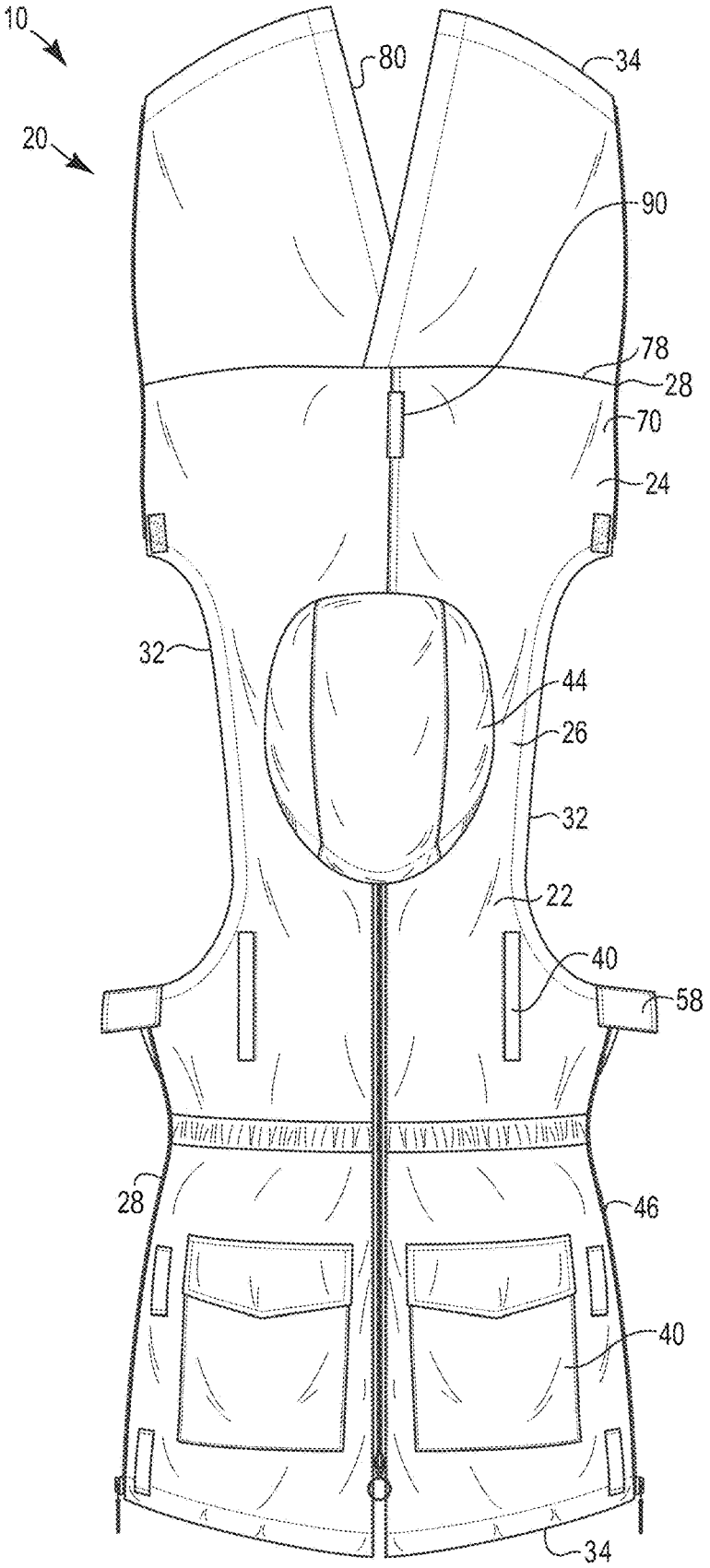
FIG. 8 is front view illustration of a torso portion and a hood portion of the garment of FIG. 1 with the torso portion in an unfolded position, that is the back panel folded upwardly to be substantially coplanar with the front panel, according to one embodiment of the present invention.
Figure 9:
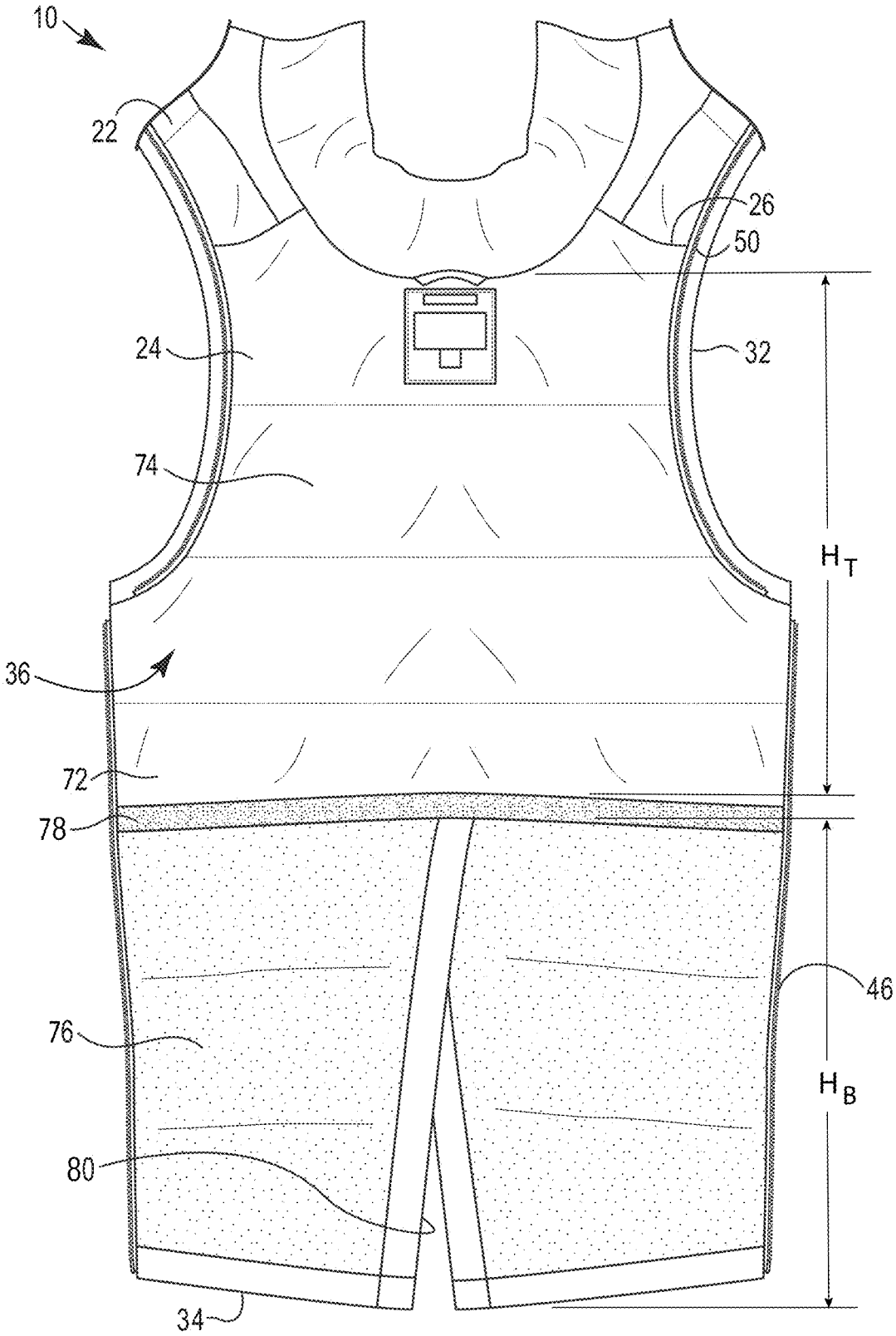
FIG. 9 is a partial front view illustration of a back panel of the torso portion of FIG. 8, according to one embodiment of the present invention.

Continuing to refer to FIGS. 7 and 8, in one embodiment, not only does each sleeve 42 detach from garment body 20 but opposing side zippers 46 serve to couple front panel 22 to rear panel 24 along opposing side edges 28 between bottom opening 34 toward and nearly to the respective one of arm openings 32. In this manner, when side zippers 46 are opened, or unzipped, garment bod 20 can be opened and laid nearly entire flat, that is with front panel 22 and rear panel 24 being substantially coplanar. This configuration can make it considerably easier to maneuver garment 10 to place it on to user 12 and or allows garment 10 to accommodate other medical equipment or backpacks, etc., that user 12 may need to keep on or near their person while using their wheelchair. In one example, a hook and loop flap fastener system 58 is included on garment body 20 bridge any gap between each side zipper 46 and its respective arm opening 32 and/or to cover and help secure each side zipper 46 against inadvertent unzipping. While side zippers 46 are particularly described and shown, other suitable couplings such as groups of snaps or magnetic fasters, etc. are also contemplated for selectively coupling front panel 22 to rear panel 24 along one or both of the opposing side edges 28 thereof.

Taking a closer look at rear panel 24, rear panel 24 includes an exterior surface 70 as illustrated in FIGS. 1-8 and an interior surface 72 opposite exterior surface 70. When positioned for use as shown in FIGS. 1-7, exterior surface 70 faces away from front panel 22 and interior surface 72, which faces in the opposite direction as exterior surface 70, faces toward front panel 70. In this manner, interior surface 72 is configured to interact with user 12 when garment 10 is worn. Interior surface 72 is configured, in one embodiment, specifically to help increase the ease in which user 12 can move into garment 10 while also to decrease undesired movement or slippage of user 12 in a wheelchair or other chair (not shown) due to garment body extending between user 12 and said wheelchair or other chair. In particular, interior surface 72 is divided into a top section 74 and a bottom section 76 with each section providing a different level of friction to facilitate user 12 in differing manners.

Top section 74 extends from a waistband 78 of garment 10 upwardly toward and, in one example, to top edges 26 and neck opening 30 of rear panel 24. Please note that as "waistband" is used in this application, it broadly denotes an extension, perhaps partially circular when garment 10 is in use, in a substantially horizontal direction, that is, in a direction substantially perpendicular to a height of garment body 20 as measured from top edge 26 to bottom opening 34, at or near the expected location of a waist (not shown) of user 12 when wearing garment 10. The term "waistband" does not require an actual "band" or additional similar physical structure thereof. In this manner, top section 74 of interior section 72 is configured to substantially align with the torso 14 of user 12 during wear of garment 10. For purposes of this application, "substantially aligns" means aligns with at least 75% of the lower body of user 12 as proportions of users 12 may vary. In one example, the top second 74 has a height HT measured between the waistband and the neck opening. In one example, top section 74 extends from one pair of one of opposing side edges 28 and a corresponding one of arm openings 32 to the other pair of the other one of opposing side edges 28 and a corresponding other one of arm openings 32. Top section 74 generally needs to slide past the back of user 12 and allow user 12 to move freely in their wheelchair as much as they are able such that top section 74 of interior surface 72 is, in one embodiment, provided with a relatively low coefficient of friction to allow for slip of user's body and or clothing against top section 74.

In one embodiment, a typical liner material such as silk, polyester, rayon, or other similar material is used to define top section 74 of interior surface 72. In one example, the same material that is used to form top section 74 of interior surface 72 is used as lining inside one or more of sleeves 42, hood 44, and or front panel 22 of garment body 20 as each of these components is best served by allowing user 12 to easily slide into and out of the respective portions of garment 10.

In contrast, in one example, bottom section 76 of interior surface 72 extends from waistband 78 downwardly toward bottom opening 34, more specifically, in one embodiment, substantially entirely to bottom opening 34. In one example, bottom section 76 extends from one pair of one of opposing side edges 28 and a corresponding one of arm openings 32 to the other pair of the other one of opposing side edges 28 and a corresponding other one of arm openings 32. In this manner, bottom section 76 of interior section 72 is configured to substantially align with a portion of lower body of user 12 during wear of garment 10. For purposes of this application, "substantially aligns" means aligns with at least 75% of the lower body of user 12 as proportions of users 12 may vary. In one example, the bottom second 76 has a height HB measured between the waistband and bottom opening 34 that is at least equal to, and in one embodiment, is at leased about 125% of a height HT. Bottom section 76 is continuous in one embodiment, while in other embodiments, bottom section 76 includes a slit, break, overlap, kick pleat, or other structure 80, which allows for additional movement of user's thigh 16 relative to rear panel 24.

While top section 74 allowed for slidable movement of user 12 relative thereto, bottom section 76 is configured conversely to decrease undesired movement of user 12 relative to bottom section 76 of interior surface 72. In this manner, bottom section 76 of interior surface 72 is formed from a material having a relatively high coefficient of friction in comparison to top section 74 of interior surface 72 to generally decrease or prevent a user from sliding along bottom section 76 of interior surface 72. In one embodiment, bottom section 76 of interior surface 72 is formed of a fleece, jersey, cotton, quilted, flannel, wool or other high friction material. Such a material is selected to generally prevent or at least decrease the likelihood that user 12 will undesirably slide down in their wheelchair or other chair while wearing garment 10.

While one of skill in the art will understand the competing aims of top section 74 and bottom section 76 of interior surface 72 of rear panel 24 after reading this application and the general desire to use differing material for each surface section, to better illustrate such function, in one embodiment, bottom section 76 of interior surface 72 will have a coefficient of friction that is at least twice, and in one example, at least four times, the coefficient of friction of the top section 74 of interior surface 72 when tested against the same material. For example, the coefficient of friction for a polyester lining, such as that used in one example for top section 74 of interior surface 72, against another fabric, such as that which may be worn by user 12, generally is in the range of about $0.12\mu_k$ and against dry skin is generally in the range of about $0.07\text{-}0.19\mu_k$. In contrast, the coefficient of friction for a fleece lining, such as that used in one example for bottom section 76 of interior surface 72, against another fabric generally is in the range of about $0.5\text{-}0.9\mu_k$ and against dry skin is generally in the range of about $0.6\text{-}0.9\mu_k$.

In one embodiment, garment body 20 includes one or more maneuvering loops 90 extending outwardly from one or both of front panel 22 and rear panel 24 in a closed U-shaped. Each one of maneuvering loops 90 is secured to garment body 20 in a reinforced manner such that it is configured to be grasped and pulled or otherwise manipulated by a caregiver allowing caregiver to more easily move user 12 while user 12 is wearing garment body 20. In this manner, in one example, maneuvering loops 90 are strategically positioned in places that permit a caregiver to have the largest impact in maneuvering user 12 at a point of contact. For example, as illustrated in FIGS. 1-6, in one embodiment, a maneuvering loop 90 is positioned in the middle back, vertical center, that is, along exterior surface 70 of rear panel 24 of garment body 20. In one example, maneuvering loop 90 is positioned along waistband 78, and for example, may be along an seam line to increase strength and decrease the chances of the maneuvering loop 90 ripping out away from rear panel 24 during use.

Figure 10:
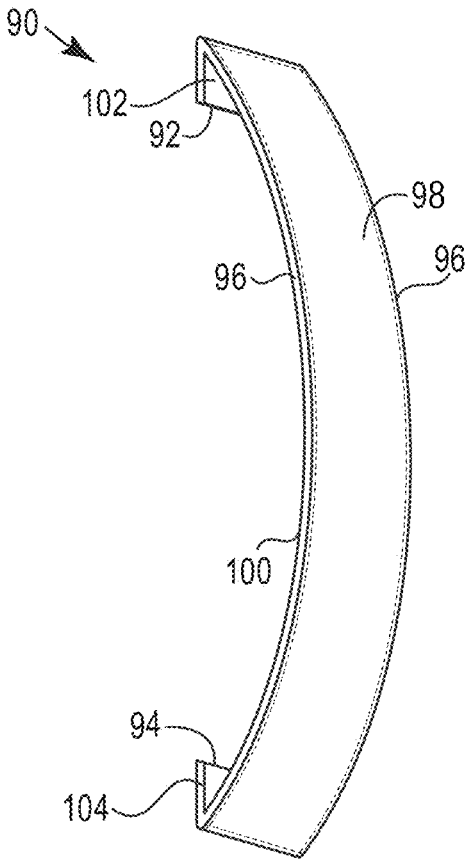
FIG. 10 is a perspective view of a loop of the garment of FIG. 2, according to one embodiment of the present invention.
Figure 11:
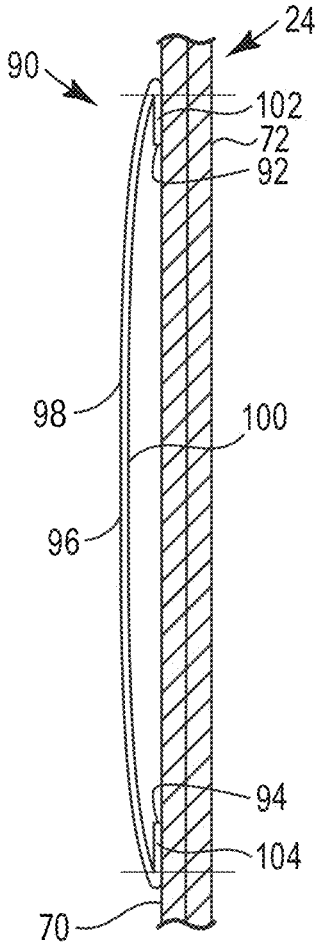
FIG. 11 is a cross-sectional view taken along the line 11-11 in FIG. 3, according to one embodiment of the present invention.
Figure 12:
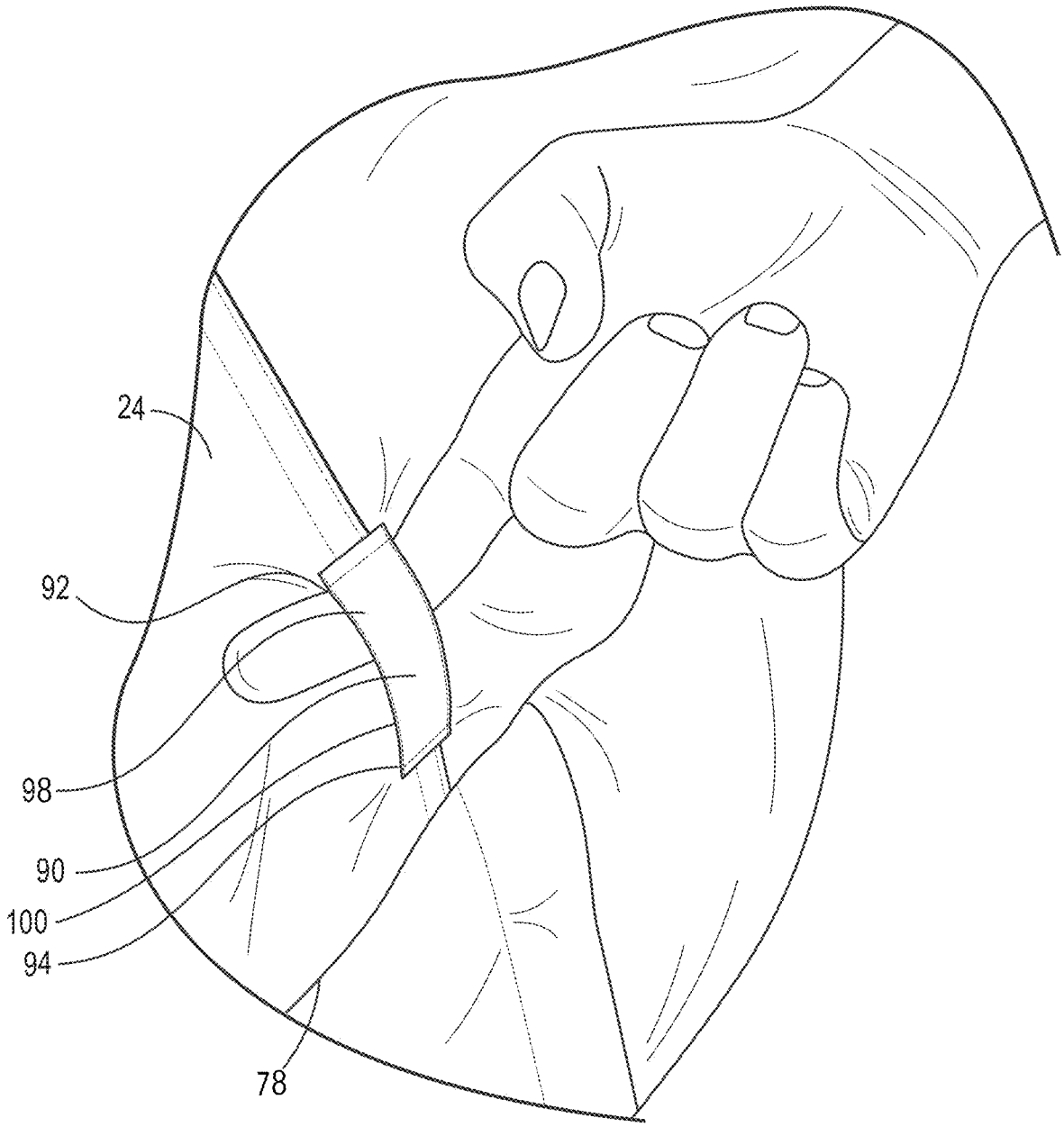
FIG. 12 is a detailed, rear, perspective view of a rear loop of FIG. 3 and a finger of a care giver during use, according to one embodiment of the present invention.

FIGS. 10 and 11 show more detailed vies of a maneuvering loop 90. Maneuvering loop 90 is formed of an elongated piece of fabric doubled up upon itself and extending between a first end 92 and a second end 94, opposite first end 92. In this way, maneuvering loop 90 defines to opposing elongated edges 96, an outwardly facing surface 98, and an inwardly facing surface 100 opposite outwardly facing surface 98. To reach each maneuvering loop 90 to be attached to garment body 20, each maneuvering loop 90 is folded over itself near each of first end 92 and send end 94 to form a first coupling tab 102 and a second coupling tab 104, respectively. The outwardly facing surface 98 of each of first and second coupling tabs 102 and 104 are placed against portion of garment body 20 they are to be coupled to, for example, the exterior surface 70 of rear panel 24, as shown in FIG. 11. Reinforced stitching 110 is placed through both rear panel 24, a respective coupling tab 102 or 104 and a corresponding adjacent portion of maneuvering loop body adjacent said coupling tab 102 and 104. In one example, similar maneuvering loops 90 are coupled to an exterior of front panel 22 for similar purposes, for instance, as shown in FIGS. 2, 4, 7, and 8.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will also be apparent to those of ordinary skill in the art upon reading this application.

What is claimed is:

1. A garment body for covering a torso and a portion of a lower body of a user when the user wears the garment body, the garment body comprising:

a front panel; and a rear panel coupled to the front panel forming a cavity therebetween to receive the torso and the portion of the lower body when the user wears the garment body, the rear panel defining an exterior surface facing away from the front panel and an interior surface facing toward the front panel, wherein:

the interior surface is divided into a top section and a bottom section, the top section is configured to at substantially align with the torso when the user wears the garment body, the bottom section is configured to substantially align with the portion of lower body of the user when the user wears the garment body, the top section of the interior surface is defined by a first lining material, and the bottom section of the interior surface is defined by a second lining material having a greater coefficient of friction than the first lining material.

2. The garment body of claim 1, wherein a coefficient of friction of the second lining material is at least about two times greater than a coefficient of friction of the first lining material.

3. The garment body of claim 1, wherein a coefficient of friction of the second lining material is at least about four times greater than a coefficient of friction of the first lining material.

4. The garment body of claim 1, wherein the first lining material is polyester and the second lining material is fleece.

5. The garment body of claim 1, wherein each of the front panel and the rear panel define opposing side edges coupled to each other on opposite sides of the cavity.

6. The garment body of claim 5, further comprising twill tape extending between opposite sides of the cavity on the rear panel and forming a boundary line between the top section and the bottom section.

7. The garment body of claim 6, wherein the bottom section has a height measured from the bottom opening to the waistband that is at least about 125% of a height of the top section measured from the top of the twill tape to the neck opening.

8. The garment body of claim 6, wherein the bottom section has a height measured from the bottom opening to the waistband that is equal to or greater than a height of the top section measured from the top of the twill tape to the neck opening.

9. The garment body of claim 1, wherein the rear panel additionally defines an exterior surface facing opposite the interior surface, and the garment body further comprises a maneuvering loop coupled to the exterior surface at opposing ends thereof and configured to facilitate maneuvering the user wearing the garment body.

10. The garment body of claim 9, wherein the maneuvering loop is a first maneuvering loop, and the garment body further comprises a second maneuvering loop coupled to the front panel and extending away from the rear panel.

11. A garment body comprising:

a front panel;

a rear panel coupled to the front panel, the rear panel defining an exterior surface facing away from the front panel and an interior surface facing toward the front panel, the interior surface additionally defining a waistband and a first lining material exhibiting a first coefficient of friction above the waistband and a second lining material exhibiting a second coefficient of friction below the waistband, wherein the second coefficient of friction is larger than the first coefficient of friction.

12. The garment body of claim 11, wherein the second coefficient of friction is at least about two times greater than the first coefficient of friction.

13. The garment body of claim 11, wherein the second coefficient of friction is at least about four times greater than the first coefficient of friction.

14. The garment body of claim 11, wherein the interior surface above the waistband is defined by a polyester material and the interior surface below the waistband is defined by a fleece material.

15. The garment body of claim 11, wherein garment body further comprises a maneuvering loop coupled to the exterior surface at opposing ends thereof and configured to facilitate maneuvering the user wearing the garment body.

16. A garment body for covering a torso and a portion of a lower body of a user when the user wears the garment body, the garment body comprising:

a front panel; and a rear panel coupled to the front panel forming a cavity therebetween to receive the torso and the portion of the lower body when the user wears the garment body, the rear panel defining an exterior surface facing away from the front panel and an interior surface facing toward the front panel, wherein:

the interior surface is divided into a top section and a bottom section and defines a waistband therebetween, the top section is configured to at substantially align with the torso when the user wears the garment body, the bottom section is configured to substantially align with the portion of lower body of the user when the user wears the garment body, the top section of the interior surface is defined by a first lining material, and the bottom section of the interior surface is defined by a second lining material having a greater coefficient of friction than the first lining material.

17. The garment body of claim 16, further comprising twill tape forming the waistline as a boundary line between the top section and the bottom section.

18. The garment body of claim 16, wherein a coefficient of friction of the second lining material is at least about two times greater than a coefficient of friction of the first lining material.

19. The garment body of claim 16, wherein a coefficient of friction of the second lining material is at least about four times greater than a coefficient of friction of the first lining material.

20. The garment body of claim 16, wherein garment body further comprises a maneuvering loop coupled to the exterior surface at opposing ends thereof and configured to facilitate maneuvering the user wearing the garment body.

* * * * *